United States Patent [19]

Brown et al.

[11] 3,963,912

[45] June 15, 1976

[54] SIGNAL RESOLVING APPARATUS

[75] Inventors: Kenneth Robson Brown, Kirknewton; Colin Keith Sharp, Edinburgh, both of Scotland

[73] Assignee: Ferranti, Limited, Lancashire, England

[22] Filed: Sept. 19, 1974

[21] Appl. No.: 507,422

[30] Foreign Application Priority Data

Sept. 22, 1973 United Kingdom ..... 44550/73

[52] U.S. Cl. ..... 235/189; 235/186; 235/194

[51] Int. Cl.[2] ..... G06G 7/22

[58] Field of Search ..... 235/189, 186, 194, 195, 235/196, 150.25, 150.26, 150.27

[56] References Cited

UNITED STATES PATENTS

| | | | |
|---|---|---|---|
| 3,260,485 | 7/1966 | Lerman et al. | 244/77 |
| 3,648,041 | 3/1972 | Beatrice | 235/189 X |
| 3,662,162 | 5/1972 | Kallio | 235/189 X |
| 3,705,980 | 12/1972 | Brickner et al. | 235/189 |
| 3,868,680 | 2/1975 | Rhodes | 235/186 X |

*Primary Examiner*—Joseph F. Ruggiero

*Attorney, Agent, or Firm*—Cameron, Kerkam, Sutton, Stowell & Stowell

[57] ABSTRACT

A multiplier circuit arrangement comprises two parallel paths for the same signal, one of the paths being associated with signal level adjusting means; and means responsive to imbalance of d.c. components including any in said parallel paths, th imbalance being in accordance with a d.c. signal in a third signal path, to produce a control signal for varying the signal level adjusting means to reduce the imbalance, so that a.c. components in said parallel paths will be unbalanced to an extent proportional to the d.c. signal in said third path. Such multipliers are particularly suited to resolving signals in a first set of axes into signals in a second set of axes where other signals are available which are combinable to give trigonometric functions required to translate between the first and second sets of axes. A plurality of multiplier circuits are used one for each coordinate of each signal to be resolved, the multiplier circuits being connected and interconnected to be responsive to corresponding coordinate signals and particular trigonometric function representative combinations of said other signals to produce product representative outputs, and means for additively combining those outputs to give the desired signals in the second axes.

4 Claims, 3 Drawing Figures

SIGNAL RESOLVING APPARATUS

This invention relates to electronic multipliers, and has application both to a particular type of multiplier for producing an output representing the product of a d.c. signal and an a.c. signal, and also to a particular arrangement of multipliers for resolving signal components in one set of axes into components in another set of axes.

The particular type of multiplier circuit concerned may be used as a modulator for impressing information represented by the amplitude of a d.c. signal on to an a.c. signal of desired frequency, say a carrier for transmission purposes. Alternatively, such a circuit can be used to multiply together two different parameters with their values represented, at any time one by an a.c. signal and the other by a d.c. signal, with an a.c. signal preferably representing the corresponding parameter by its amplitude.

According to one aspect of the invention there is provided a multiplier circuit arrangement comprising two parallel paths for the same signal, one of the paths being associated with signal level adjusting means; and means responsive to imbalance of d.c. components including any in said parallel paths, said imbalance being in accordance with a d.c. signal in a third signal path, to produce a control signal for varying said signal level adjusting means to reduce said imbalance, so that a.c. components in said parallel paths will be unbalanced to an extent proportional to the d.c. signal in said third path.

Perferably, the signal level adjusting means includes a branch from said one path via variably resistive means, advantageously a field-effect transistor with its gate responsive to said control signal.

Such a circuit can be used to provide, from a junction of at least the parallel paths, an a.c. output representative of the product of an a.c. input signal applied to the parallel paths and a d.c. input signal supplied to the third path. Clearly this is equivalent to amplitude modulation of the a.c. input signal in accordance with the d.c. input signal.

It is convenient to connect the third path directly to the junction at which the a.c. output is taken from the parallel paths. Preferably, the a.c. output is taken via the means responsive, which may comprise a summing amplifier having an a.c. feedback path to a virtual earth input for the abovementioned junction of the parallel paths. If at least one other path is also connected to the junction for application of a further d.c. input signal, the circuit output will represent a product involving the sum of the d.c. input signals.

Alternatively, the further d.c. input signal may be applied directly to influence the d.c. component in said one of the parallel paths. Conveniently, this other path includes signal inverting means and the third path is connected to the input of the signal inverting means, so that the a.c. output of the circuit will be of opposite sign compared with its first-mentioned application at the input of the means responsive. If d.c. input signals are made to both the input of such signal inverting means and the input of the means responsive, the a.c. output of the circuit will represent a product involving the difference between the d.c. input signals.

It is frequently necessary to respond to signals, for example representative of errors, produced as components in first axes to generate other signals, for example representative of required correction, as components in second axes. In general, this required resolution of each of the first axes components into the second axes and summing to form second axes components. In an inertial platform, say for aircraft, error signals representing angular deviations in tilt about platform axes are generated by gyros associated with the platform. From these error signals it is necessary to produce correction signals to be applied to gimbal servo systems in different axes. Previously, such operations have been performed in relation to the output of an azimuth synchro on the platform by a mechanical resolving system driven by the synchro motor.

It would be advantageous to have a relatively compact electronic system capable of replacing the mechanical system, preferably at lower cost.

According to another aspect of the invention there is provided apparatus for resolving signals in a first set of axes into signals in a second set of axes where other signals are available which are combinable to give trigonometric functions required to translate between the first and second axes, the apparatus comprising a plurality of multiplier circuits one for each co-ordinate signal to be resolved, the multiplier circuits being connected and interconnected to be responsive to corresponding co-ordinate signals and particular trigonometric function representative combinations of said other signals to produce product representative outputs additively to give the desired signals in the second axes.

Where said other signals yield the desired trigonometric functions simply by addition with appropriate signs, the multipliers may conveniently have both summing and inverting inputs so that the desired additions and subtractions of said other signals occur as a result of their application to the multiplier, i.e. simultaneously with the multiplying action.

In preferred embodiments of the invention for controlling an aircraft inertial platform, said other signals comprise outputs from an azimuth synchro, preferably a three wire synchro with one wire grounded so that outputs from the other two will give cosine or sine functions when added or subtracted.

Clearly, multiplier circuits embodying the first aspect of this invention are readily applicable as the multipliers of the second aspect being inherently suitable for performing the desired addition and subtraction operations by the way in which the d.c. input signals are applied. Then, the signal components to be resolved will preferably be amplitude significant a.c. signals and said other signals will be d.c. signals resulting from demodulating the synchro signals.

One embodiment of a multiplier circuit of the invention will now be specifically described, by way of example, with reference to FIG. 1 of the accompanying drawings which shows a circuit diagram.

A multiplier circuit is shown having a terminal 10 for application of an a.c. input signal, a terminal 11 for application of a d.c. input signal, and a terminal 12 for an output signal representative of the product of the input signals applied at terminals 10 and 11.

The a.c. input terminal 10 is coupled via capacitor 13 to one common point 14 of two parallel circuit paths 15 and 16 extending to a junction point 17 at their other ends. A potential divider comprises resistors 18 and 19 connected between a ground rail 20 and a terminal 21, and serves to supply a predetermined d.c. voltage to the common point 14. Means 22 is provided for responding to imbalance of d.c. signal components at the junction point 17 by producing a corresponding output signal. An inverting amplifier 23 with feedback via resistor 24 to its virtual earth input is provided in the parallel circuit path 15. The means 22 conveniently comprises a summing amplifier having one input 25 connected to the junction point 17 and representing a virtual earth. Any imbalance in current flow in the other parallel path 16 via resistor 26 compared with that in the output of the inverter 23 via resistor 27 will give a nett input signal to the amplifier 22, which is shown connected with an a.c. feedback path from its output 28 via a resistor 29 and a capacitor 30 to its input 25. The amplifiers 22 and 23 conveniently comprise commercially available integrated circuits often referred to as operational amplifiers.

Any output signals resulting from a nett d.c. signal at the junction point 17 is used to control signal level adjusting means associated with the parallel path 15 and operative to vary the d.c. component therein in order to balance d.c. components through resistors 26 and 27. This signal level adjusting means is operative on the input to the inverter 23. The control signal on amplifier output 28 is taken over path 31 from the resistor 29, via another resistor 32 and junction 33 between that resistor and a capacitor 34 connected to the earth rail 20, and used to control the conductivity of a field effect transistor 35 preferably of the insulated gate type. This field effect transistor 35 is the variable element of the signal level adjusting means which is shown as a resistive T-network having resistors 36 and 37 in series directly in the path 15 and a branch path 38 from their mid-point to the earth rail 20 via the source-drain circuit of the field effect transistor 35 the gate of which is controlled by the amplifier output 28.

In this specific embodiment an n-channel field effect transistor is assumed so that a negative polarity of the control signal causes the source-drain resistance to increase. Then, less of the d.c. component in path 15 from the point 14 will pass down the branch path 38 and more of this component will be applied to the input of the inverting amplifier 23. Assuming a positive d.c. potential to be applied at the terminal 21, the output of the amplifier 23 will go more negative and the input virtual earth will be maintained by the feedback path including resistor 24. This will allow for compensating an imbalance resulting in a nett positive d.c. signal at the junction point 17. The summing amplifier 22 thus also needs to be inverting.

In the absence of a.c. and d.c. input signals at terminals 10 and 11 the circuit adjusts the level of conduction of the field effect transistor 35 so that all of the d.c. current that reaches the junction 17 via the parallel path 16 over resistor 26 is then taken over resistor 27 in the parallel path 15. The parallel paths 15 and 16 are thus in balance at the junction point 17 for d.c. signals applied at the common point 14 and there will be no nett input to the amplifier 22 which will have a constant level.

In an a.c. input signal is now applied to the terminal 10, and via capacitor 13 to the point 14, equal a.c. signals of opposite phase will flow in the resistors 26 and 27, and again there will be no output from the amplifier 22. The terminal 11 for a d.c. input signal is shown connected to the junction point 17 over a resistor 39. If a d.c. input is presented, the balance of d.c. components at the junction point 17 will be upset, and an output signal will appear on line 31 that has a d.c. component dependent on the input d.c. signal at the terminal 11. This will cause immediate adjustment of the conductivity of the field effect transistor 35 to alter the d.c. current flow over resistor 27 to produce balance at the junction point 17 that is virtual earthed by the amplifier 22.

The alteration of resistance of the transistor 35 can be viewed as causing a change in overall gain in the parallel path 15 resulting in the anti-phase a.c. components in the two paths 15 and 16 no longer being of equal amplitude, and thus not in cancelling relation to each other at the junction point 17. A nett a.c. signal will therefore be applied to the input 25 of amplifier 22 to produce a corresponding a.c. output which will be coupled to the output terminal 12 via a capacitor 40. Clearly, the capacitor 30 will also need to by-pass the a.c. signal frequencies in output 28. The a.c. output signal at the terminal 12 will have an amplitude dependent on the value of the d.c. input signal at the terminal 11 and so will represent product modulation of the a.c. input signal at terminal 10.

If there is sufficient difference in the resistance of the transistor 35 for d.c. and a.c. signals to undesirably affect operation of the circuit, compensation is conveniently made in the reference one, 16, of the parallel paths. This is indicated by the dotted line connection from both sides of the resistor 26 to a series combination of a resistor 43 and a capacitor 44. The capacitor 44 ensures that the resistor 43 is effective only for components of the a.c. input signal from terminal 11. Other, d.c., components at the common point 14 will see only the resistor 26 in the path 16.

If a further d.c. input is made to the junction point 17, over another resistor 39, the output 12 of the circuit will represent a product involving the sum of that further d.c. input and the one applied to terminal 11. A dashed connection branch 45 is shown to indicate this possibility. Alternatively, of course, both d.c. inputs may be applied additively via the same terminal 11, but the provision of separate input terminals may be more convenient in some applications e.g. to give a general purpose device.

Due to the presence of the inverter 23 in the circuit path 15, a change of sign of the output relative to the d.c. input signal can be obtained if a connection is used to the input of the inverting amplifier instead of via the resistor 39 to the junction point 17. Provision for such connection is indicated by the dashed circuit branch 46. If such a branch 46 is used at the same time as a branch 39 or 45 but for a different d.c. input signal, the circuit will produce an output signal representing a product involving the difference between the two d.c. input signals.

Also, if additional a.c. signal components are applied to a multiplier at the input to the summing amplifier 22, a composite a.c. signal will result representing addition of that component to the previous output of the multiplier. This facility is useful if combining components resolved from one set of axes into another set of axes.

Specific application of such multipliers to inertial platform control will now be described, by way of example, with reference to FIGS. 2 and 3 of the drawings, in which:-

In an inertial navigation system, say for an aircraft or a submarine, a gimbal-mounted inertial platform is associated with two gyros for detecting angular displacement of the platform relative to respective platform axes. Outputs $V_1$ and $V_2$ of these gyros need to be translated to provide appropriate correction signals for application to two gimbal servos for displacing the platform relative to gimbal axes. It is known that inputs $Vo_1$ and $Vo_2$ are required for the gimbal servos, respectively, where;

$$Vo_1 = A(V_1 \sin\theta + V_2 \cos\theta) \quad 1$$

and $$Vo_2 = A(V_1 \cos\theta - V_2 \sin\theta) \quad 2$$

A is a transformation constant and $\theta$ is the shaft angle. The voltages are conventionally 400 Hz a.c. signals.

Signals corresponding to $\sin\theta$ and $\cos\theta$ are derived using outputs from a three-wire azimuth synchro.

Figure 2:
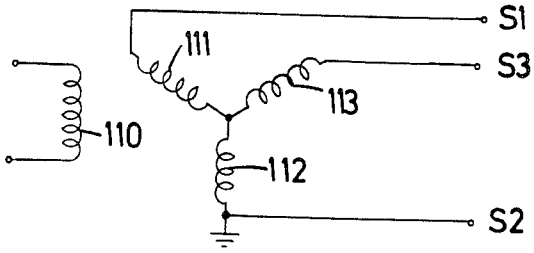
FIG. 2 is a circuit schematic of a three-wire azimuth synchro.

FIG. 2 shows an input winding 110 of an azimuth synchro having three outputs windings 111, 112, 113 at 120° angular intervals feeding output terminals S1, S2 and S3, respectively. The output terminal S2 is earthed and outputs are taken as follows:

$$Vs_3 = \overline{V} \sin(\theta + 120°) \quad 3$$

$$Vs_1 = \overline{V} \sin(\theta + 240°) \quad 4$$

Where $\overline{V}$ is an alternating voltage applied to the input winding 10, B is a transformation constant, and $\theta$ is the shaft angle.

It can be shown that:

$$Vs_3 + Vs_1 \; \alpha \; \overline{V} \cos\theta \quad 5$$

$$Vs_3 - Vs_1 \; \alpha \; \overline{V} \sin\theta \quad 6$$

Thus, the synchro outputs when additively and subtractively combined yield cosine and sine functions of the shaft angle, and are used in generating terms of the equations 1 and 2.

Figure 1:
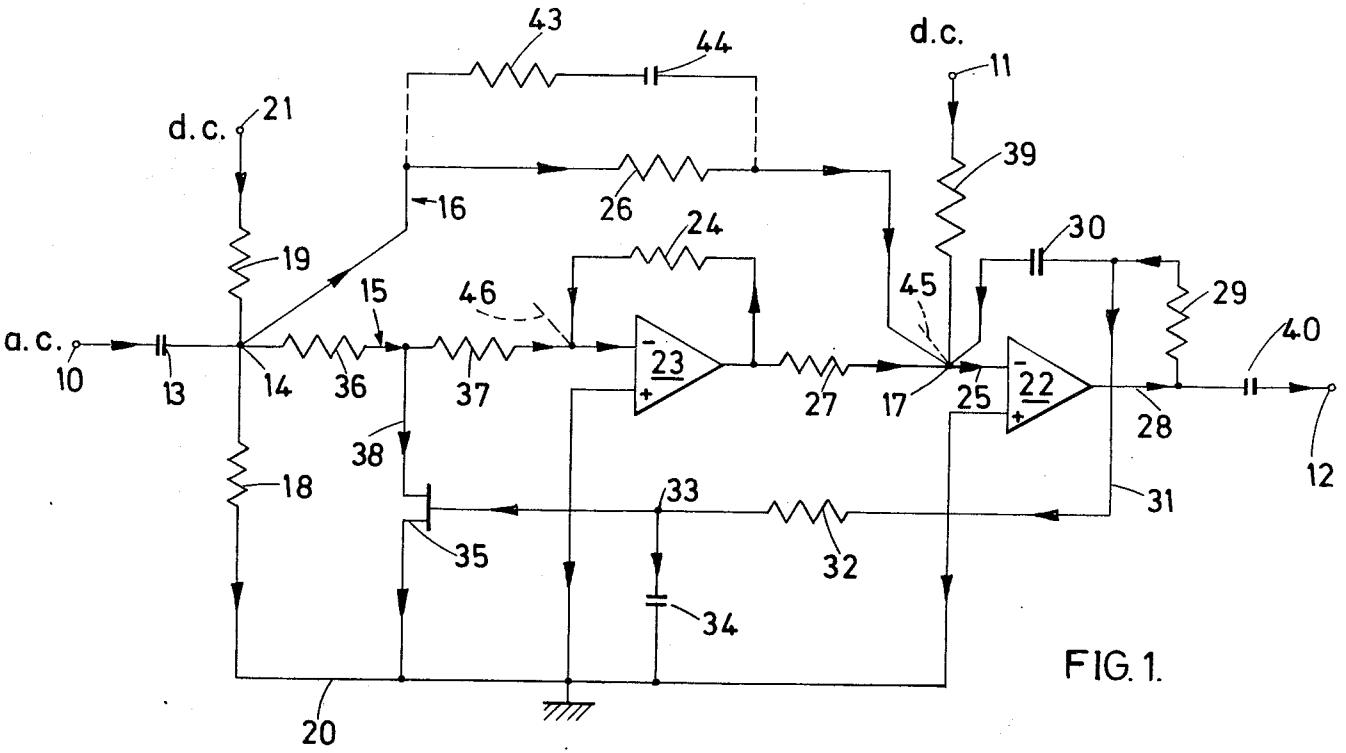

It is preferred to demodulate the synchro output signals to give d.c. input signals for multipliers of the type shown in FIG. 1. As has been mentioned above, such multipliers impress a d.c. input signal onto an a.c. input signal so as to form a product. Furthermore, two d.c. input signals can be additively or subtractively combined according to whether they are applied to the input of the summing or the parallel path inverting amplifier 22, 23 respectively. Both of these amplifiers provide a virtual earth at their inputs for the d.c. signals.

Figure 3:
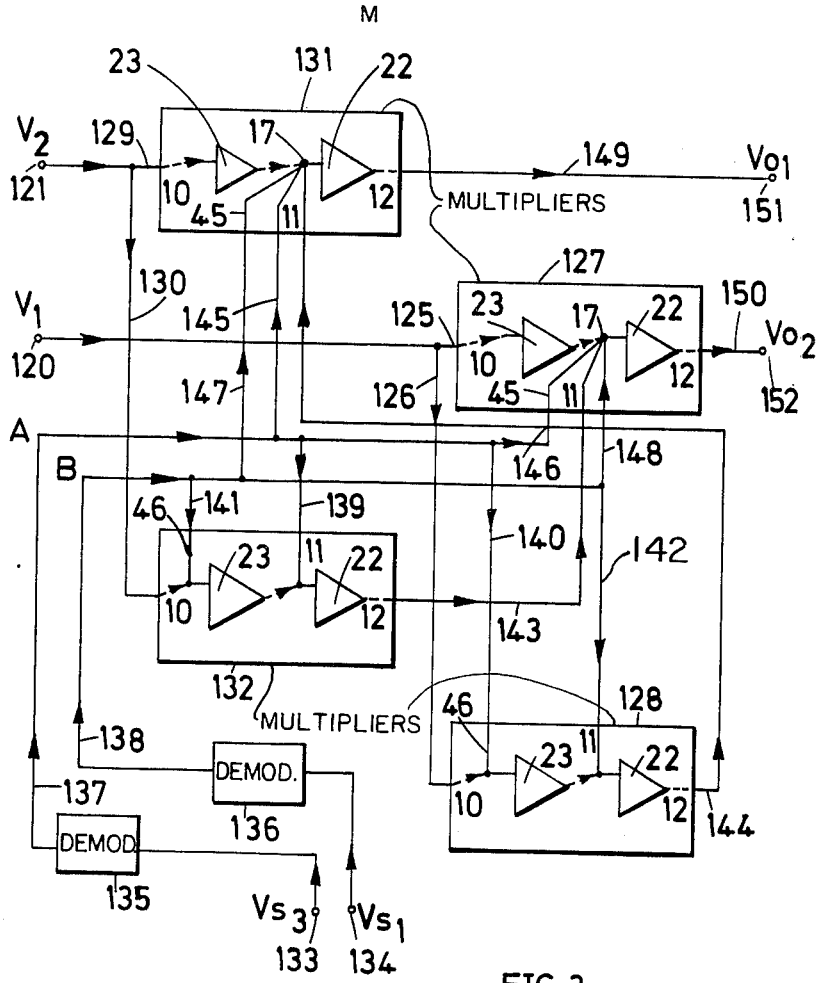
FIG. 3 is a block diagram showing a resolver for an inertial platform.

The gyro output signals $V_1$ and $V_2$ are shown applied via terminals 120 and 121, respectively in FIG. 3. The terminal 120 is connected via branch lines 125 and 126 to the a.c. input terminals 10 of multipliers 127 and 128, respectively. The terminal 121 is similarly connected via branch lines 129 and 130 to the a.c. input terminals 11 of the multipliers 131 and 132, respectively.

The a.c. synchro output signals $Vs_3$ and $Vs_1$ are shown applied via terminals 133 and 134 to demodulators 135 and 136, respectively. These demodulators 135 and 136 produce d.c. outputs, on lines 137 and 138, respectively, which are applied via appropriate adding and subtracting d.c. inputs of the multipliers to provide sine and cosine functions. To this end, the line 137 is connected via branches 139 and 140 to the summing (11) and inverting (46) d.c. inputs of the multipliers 132 and 128, respectively, and the line 138 is connected via branches 141 and 142 to the inverting (46) and summing (11) d.c. inputs of the multipliers 132 and 128 respectively. Outputs 143 and 144 of the multipliers 132 and 128 thus represents $V_2(Vs_3 - Vs_1)$ and $V_1(Vs_1 - Vs_3)$, respectively. From equation 6 above, outputs 143 and 144 represents $V_2$ sine $\theta$ and $V_1$sine$\theta$ respectively.

The lines 137 and 138 are also connected via branch 145, 146, and 147, 148 to the summing junction points 17 of both of the multipliers 131 and 127 via the d.c. inputs 11 and 45. These multipliers 131 and 127 will thus provide the products $V_2(Vs_3 + Vs_1)$ and $V_1(Vs_3 + Vs_1)$, respectively. From equation 5 above these products represent $V_2\cos\theta$ and $V_1 \cos\theta$. The output lines 143 and 144 of the multipliers 132 and 128 are shown connected to the summing junctions 17 of the multipliers 127 and 131, respectively, to combine a.c. components additively in providing the desired signals $Vo_1$ and $Vo_2$ on output lines 149 and 150 from the multipliers 131 and 127, respectively, to the output terminals 151 and 152. These outputs are in accordance with equations 1 and 2 above so that the overall connection and interconnection of the multipliers of FIG. 2 can be seen to perform the required resolution between the axes of the gyros and those of the gimbal servos.

The particular preferred multipliers are able to provide different transformation constant for sine and cosine function generation by reason of the application of one d.c. input to the inverter amplifier 23 only for sine function generation. This will give a different overall gain for the multiplier compared with applying d.c. inputs only to the input of the summing amplifier 22 and can compensate for a $\sqrt{3}$ transformation factor present in equation 5 but not equation 6 above.

An electronic resolver system could, of course, be realised using different types of multiplier circuits. For modulation type circuits requiring a.c. and d.c. inputs, the d.c. combination necessary to provide the trigonometric functions can be performed on the outputs of the demodulators 135 and 136 prior to their application to the multipliers. Alternatively, an optional inverting d.c. input may be provided at the multiplier. Different scaling may also be provided with the combining or inverting operation.

What we claim is:

1. Signal resolving apparatus comprising first input terminals for applying coordinate input signals in a first set of axes, second input terminals for applying further input signals which, when combined with one another in predetermined ways, give trigonometric functions required to translate between the first set of axes and a second set of axes, output terminals for supplying output signals in said second set of axes, and multiplier circuits, one for each coordinate of each signal to be resolved, connected to respond to the appropriate coordinate signal and to combinations of the further input signals representing particular trigonometric functions to produce outputs representing the product of the inputs, and means for additively combining the outputs to give the desired output signals in the second axes.

2. Apparatus as claimed in claim 1 in which each multiplier circuit has both summing and inverting inputs connected to the said second input terminals so that the further signals are combined to give the desired trigonometric function simultaneously with the multiplication action.

3. Apparatus as claimed in claim 1 in which the coordinate signals to be resolved are a.c. signals, and said further signals are d.c. signals.

4. Apparatus as claimed in claim 2 in which the coordinate signals to be resolved are a.c. signals and said further signals are c.c. signals.

* * * * *